US006031502A

United States Patent [19]

Ramanujam et al.

[11] Patent Number: 6,031,502

[45] **Date of Patent: *Feb. 29, 2000**

[54] ON-ORBIT RECONFIGURABILITY OF A SHAPED REFLECTOR WITH FEED/ REFLECTOR DEFOCUSING AND REFLECTOR GIMBALLING

[75] Inventors: Parthasarathy Ramanujam; Louis R. Fermelia, both of Redondo Beach; Cynthia A. Dixon, Rancho Palos Veredes; Miguel A. Estevez, Culver, all of Calif.

[73] Assignee: Hughes Electronics Corporation, Los Angeles, Calif.

[ * ] Notice: This patent is subject to a terminal disclaimer.

[21] Appl. No.: 08/753,660

[22] Filed: Nov. 27, 1996

[51] Int. Cl.[7] ..... H01Q 3/12; H01Q 19/10

[52] U.S. Cl. ..... 343/761; 343/781 P; 343/839

[58] Field of Search ..... 343/781 P, 761, 343/837, 839, 840, 764, 781 R; H01Q 3/12, 19/10, 19/19

[56] References Cited

U.S. PATENT DOCUMENTS

| | | | |
|---|---|---|---|
| 3,302,205 | 1/1967 | Johnson | 343/837 |
| 3,832,715 | 8/1974 | Afifi et al. | 343/761 |
| 3,882,503 | 5/1975 | Gamara | 343/839 |
| 4,586,051 | 4/1986 | Saitto et al. | 343/DIG. 2 |
| 4,772,892 | 9/1988 | Payelian et al. | 343/761 |
| 5,546,097 | 8/1996 | Ramanujam et al. | 343/781 R |
| 5,579,018 | 11/1996 | Francis et al. | 343/761 |

*Primary Examiner*—Michael C. Wimer

*Attorney, Agent, or Firm*—Terje Gudmestad; Georgann S. Grunebach; Michael W. Sales

[57] ABSTRACT

A system and method for changing the radiation pattern of an antenna assembly of a satellite in orbit is provided. The antenna assembly includes a reflector antenna fed by a feed assembly. The reflector antenna transmits and receives signals within a radiation pattern. The reflector antenna and the feed assembly are movably mounted to a sliding mechanism so that they can be displaced with respect to one another. The displacement causes defocusing as the reflector antenna is displaced from the focus point. The defocusing causes the radiation pattern to become more compact or broadened. Thus, the radiation pattern of the satellite provided with a single reflector antenna and a single feed element may be changed while the satellite is in orbit. The system and method include gimballing the reflector antenna to steer the radiation pattern.

14 Claims, 4 Drawing Sheets

ON-ORBIT RECONFIGURABILITY OF A SHAPED REFLECTOR WITH FEED/ REFLECTOR DEFOCUSING AND REFLECTOR GIMBALLING

TECHNICAL FIELD

The present invention relates to satellite communications and, more particularly, to a system and method for defocusing an antenna assembly of a satellite to change the radiation pattern of the satellite.

BACKGROUND ART

Communication satellites are employed to receive electromagnetic signals from an earth station and then retransmit these signals to one or more earth stations. The signals contain information such as voice, video, and data for communication between the earth stations via the satellite. In essence, the purpose of a satellite is to transmit information from a sender to a receiver.

Typically, the power of the received signal at the satellite is weak because most of the power is lost through earth to satellite transmission path losses. The path losses are a result of the distance separating the satellite and the earth. The power of the received signal varies inversely as the square of the distance. For instance, the power of a signal transmitted by a feeder earth station may be around 1000 Watts, but the power of the signal received by the satellite may only be 1 nano Watt ($10^{-9}$ W).

Because the power of the signal received by the satellite is too weak for transmission, the satellite has an amplifier to amplify the received signal. After amplification, the satellite transmits the amplified signal back to a receiving earth station. The satellite may employ additional techniques such as demodulation and modulation to process the received signal before transmission. Again, during transmission, most of the power of the transmitted signal is lost through satellite to earth transmission path losses. For instance, the satellite may transmit a signal having a power of 10 Watts after amplification, but only 10 pico Watts ($10^{-12}$ W) is received by the feeder earth station.

Satellites employ antennas to transmit and receive signals because antennas have the ability to direct the signals to a specific location and the ability to tune to signals emanating from a specific location. Antennas can transmit signals having given frequencies to a specific location by focusing the signals into what is referred to as a radiation pattern. Similarly, antennas tune to the same radiation pattern to receive signals with the given frequencies emanating from the specific location. Antennas have the property of transmitting and receiving identical radiation patterns because they are reciprocal devices. Typically, antennas perform both of these operations at once by using slightly different signal frequencies in a frequency band. However, the variation of the frequencies are usually of the same magnitude so that the radiation pattern is the same in both modes.

In the transmit mode, the antenna forms a radiation pattern by increasing the power transmitted in a selected direction while reducing the power transmitted in other directions. The measure of the ability of an antenna to transmit power in a selected direction rather than equally in all directions is referred to as the directivity of the antenna. An interrelated concept to directivity is gain. The gain of an antenna is the measure of the ability of an antenna to increase the power to a given area by reducing the power to other areas.

In the receive mode, the antenna gathers energy from impinging electromagnetic energy. Because of reciprocity, the antenna is tuned to gather energy emanating from areas within the radiation pattern while being non-receptive to signals emanating from all other areas. The measure of the ability of an antenna to gather energy from a specific area is referred to as the effective aperture of the antenna. In general, a high effective aperture antenna in the receive mode also exhibits a high gain in the transmit mode.

Typically, satellites employ some sort of antenna assembly. The antenna assembly consists of a main reflector and a feed assembly. The main reflector is usually a parabolic reflector or a shaped reflector. In the transmit mode, the feed assembly illuminates the main reflector with an electromagnetic energy beam. The main reflector then reflects and focuses the electromagnetic energy beam into a radiation pattern for transmission to earth. In the receive mode, the main reflector focuses impinging electromagnetic energy from a radiation pattern into a reflected beam on the feed assembly.

The feed assembly is usually located at a focal point of the main reflector either on the axis perpendicular with the center of the main reflector or offset from this axis. Because the feed assembly may intercept a small part of the reflected beam from the main reflector, the feed assembly is often offset so that it is outside of the reflected beam. This is especially true for main reflectors having a small size.

The feed assembly may have various configurations. For instance, the feed assembly may consist of a single feed element such as a feed horn directed towards the main reflector. The feed assembly may also consist of a sub-reflector directed at the main reflector and a feed element directed at the sub-reflector. In this scenario, the feed element illuminates the sub-reflector with electromagnetic energy. The sub-reflector then reflects this energy to illuminate the main reflector.

Because of the extreme losses caused by the transmission distance, it is desirable to reduce the amount of wasted power transmitted from the satellite antenna. Power is wasted when unwanted areas such as the ocean receive a portion of the transmitted signal. Accordingly, the antennas are designed to transmit signals having radiation patterns such that the pattern contour fits the shape of a desired coverage region. For instance, the desired coverage region may be the island of Japan, the continental United States, or even a time zone.

Similarly, because of the transmission losses, it is desirable for the antenna to tune to the desired coverage region so that it gathers as much power as possible from the region while not gathering power from outside of the region. As discussed above, when an antenna is designed to transmit energy to a desired coverage region, because of reciprocity, this region is also where the antenna tunes to gather energy.

One known method for producing shaped contour radiation patterns is an array-fed parabolic reflector. Another known method is a direct radiating planar array. Both approaches generally employ passive beamforming networks to weight the array elements. However, there are several disadvantages associated with these methods. First, they need operating power which is a problem for a satellite that has limited supply power available. Second, they are expensive to incorporate in a satellite. Third, the electromagnetic energy loss associated with the passive beamforming networks may be intolerable.

Another known method for producing shaped contour radiation patterns is to use a feed assembly with a shaped main reflector. The shaped main reflector is a main reflector that has had its surface shaped to produce a desired radiation pattern. A primary disadvantage associated with shaped reflectors is that the radiation patterns generated by these reflectors are fixed and have to be decided upon before launch of the satellite. Specifically, the shape of the reflector and the position of the feed are designed for a given fixed radiation pattern and position of the satellite. Because of the expanding satellite market, the requirements are continuously changing requiring on-orbit reconfigurability, i.e., changing the radiation patterns while in orbit.

In addition to using the previously introduced beamforming networks to change the radiation pattern of a shaped reflector, prior designs discuss changing the surface of the shaped reflector while in orbit. This is a fairly complex scenario requiring a number of actuators located at many points over the reflector surface. No practical implementation has been accomplished for a satellite in orbit due to the complexity.

SUMMARY OF THE INVENTION

Accordingly, it is an object of the present invention to provide a method and system for changing the radiation pattern of a satellite provided with an antenna assembly by defocusing the antenna assembly.

It is another object of the present invention to provide a method and system for changing the radiation pattern of signals transmitted to earth by a satellite provided with a reflector antenna fed by a feeder assembly by defocusing the reflector antenna and the feeder assembly.

It is still another object of the present invention to provide a method and system for changing the radiation pattern of signals received from earth by a satellite provided with a feeder assembly fed by a reflector antenna by defocusing the reflector antenna and the feeder assembly.

It is still yet another object of the present invention to provide a method and system for scanning a radiation pattern of changing size over a specified region of the earth.

In carrying out the above objects, the present invention provides a communication system for a satellite orbiting earth. The system includes a sliding mechanism. The system further includes a reflector antenna for transmitting a radiation pattern of electromagnetic energy. A feed assembly illuminates the reflector antenna with electromagnetic energy. The reflector antenna transmits the electromagnetic energy received from the feed assembly in the radiation pattern to Earth. At least one of the reflector antenna and the feed assembly are movably mounted to the sliding mechanism to enable defocusing between the reflector antenna and the feed assembly to change the radiation pattern. The system may further include a gimballing mechanism for tilting and rotating the reflector antenna to steer the radiation pattern. The reflector antenna may be a shaped reflector antenna having a shaped surface for transmitting a shaped radiation pattern of electromagnetic energy.

Further, in carrying out the above objects, the present invention provides a method for a satellite orbiting Earth provided with a feed assembly and a reflector antenna for transmitting electromagnetic energy in a radiation pattern. The method includes illuminating the reflector antenna with electromagnetic energy from the feed assembly. The reflector antenna then transmits the electromagnetic energy in the radiation pattern to Earth. At least one of the reflector antenna and the feed assembly are then displaced to enable defocusing between the reflector antenna and the feed assembly to change the radiation pattern. The method may include steering the radiation pattern.

Still further, in carrying out the above objects, the present invention provides a method for a satellite orbiting Earth provided with a feed assembly and a reflector antenna for receiving electromagnetic energy in a radiation pattern. The method includes receiving electromagnetic energy in the radiation pattern with the reflector antenna. The reflector antenna then illuminates the feed assembly with the electromagnetic energy received from the reflector antenna. At least one of the reflector antenna and the feed assembly are then displaced to enable defocusing between the reflector antenna and the feed assembly to change the radiation pattern. The method may include steering the radiation pattern.

The advantages accruing to the present invention are numerous. Current shaped reflector designs have fixed radiation patterns and thus cannot be adapted to changing requirements. Therefore, in some applications, the satellites become over designed and cover larger areas than required. In other applications, the satellites become under designed and cover smaller areas than required. The present invention allows a nominal antenna shape design to be chosen with a fairly wide range of variation of radiation patterns which can be effected after the satellite is launched and in orbit. The variation is accomplished in a relatively simple method saving an appreciable amount of cost and obtaining a reduction in complexity.

These and other features, aspects, and embodiments of the present invention will become better understood with regard to the following description, appended claims, and accompanying drawings.

BEST MODES FOR CARRYING OUT THE PRESENT INVENTION

Figure 1:
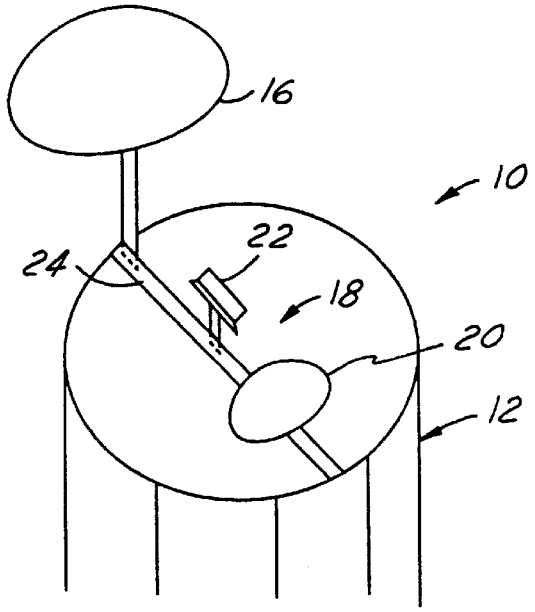
FIG. 1 is a perspective view of a communication satellite provided with an antenna system according to the present invention.

Referring now to FIG. 1, a communication system 10 is shown. System 10 includes a satellite 12 and an antenna assembly 14. Satellite 12 is placed in orbit above the surface of the earth to enable antenna assembly 14 to transmit and receive signals from stations on earth (not specifically shown).

Antenna assembly 14 includes a main reflector antenna 16 and a feed assembly 18. Feed assembly 18 includes a sub-reflector antenna 20 and a feed element 22. When satellite 12 is receiving signals from a station on earth, main reflector 16 gathers signals from the station which are propagating towards the satellite. Main reflector 16 reflects the impinging signals and focuses them towards the sub-reflector 20 to illuminate the sub-reflector. Sub-reflector 20 then reflects these signals and focuses them even further towards feed element 22. Feed element 22 is connected to receiving electronics such as an amplifier and demodulator to enable satellite 12 to process the received signals for re-transmission (not specifically shown).

Feed element 22 is also connected to transmitting electronics such as an amplifier and modulator to enable satellite 12 to transmit signals to earth (not specifically shown) When satellite 12 is transmitting signals towards a station on earth, feed element 22 radiates signals into a wide beam towards sub-reflector 20 to illuminate the sub-reflector. Sub-reflector 20 then reflects the signals into a wider beam towards main reflector 16. Main reflector 16 then reflects and focuses the signals towards a station or target on earth.

Antenna system 14 also includes a sliding mechanism 24. Main reflector 16 and feed assembly 18 are slidably attached to sliding mechanism 24. Main reflector 16, sub-reflector 20, or feed element 22 can move along sliding mechanism 24. Thus, either of these elements may be axially displaced from the focus point.

Figure 2:
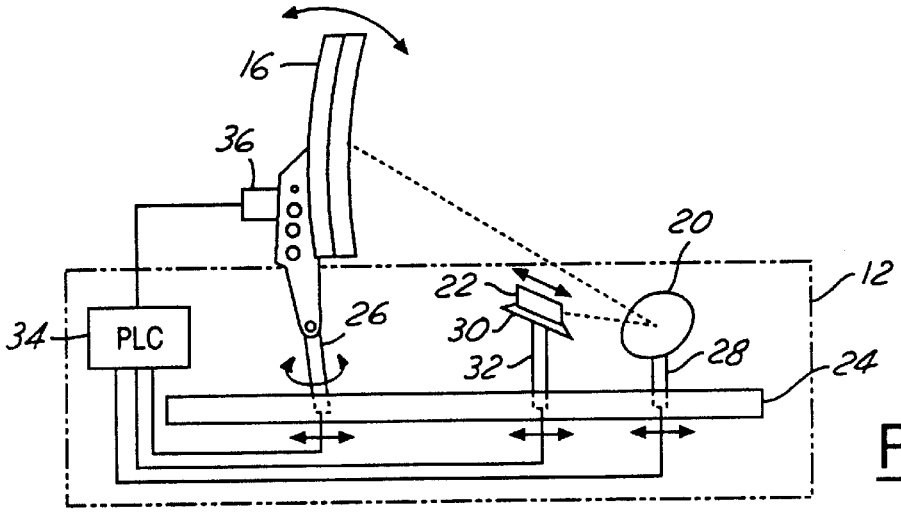
FIG. 2 is a top plan view of the communication satellite shown in FIG. 2.

Referring now to FIG. 2, a top plan view of system 10 is shown. Main reflector 16 is slidably attached to sliding mechanism 24 with a rotatable support 26. Rotatable support 26 is rotatable to turn main reflector 16 for beam steering as will be discussed in greater detail below. Similarly, sub-reflector 20 is slidably attached to a support 28. Feed element 22 is slidably attached to a base 30 to enable the feed element to move diagonally along the base. Base 30 is slidably attached to sliding mechanism 24 with a support 32 to enable feed element 22 to move along the sliding mechanism.

Main reflector 16, sub-reflector 20, and feed element 22 are all positioned a given distance from each other to produce a given radiation pattern. Usually, the initial distance is chosen so that feed element 22 is at the focus of main reflector 16. Main reflector 16 is preferably a shaped reflector. However, main reflector 16 may be some other type of reflector such as a parabolic reflector.

A shaped reflector is a reflector that has had its surface modified to produce a desired radiation pattern. A parabolic reflector has a smooth surface. For instance, a parabolic reflector fed by a single feed will produce a simple radiation pattern such as a cone. In this scenario, energy will be wasted if the radiation pattern is bigger than the target. Also, energy will not reach parts of the target if these parts are outside of the radiation pattern. On the other hand, a shaped reflector can be deformed to produce an arbitrarily shaped radiation pattern such as the configuration of a country or island. In this case, energy can be efficiently utilized because all areas of the target are covered by the radiation pattern. Similarly, none of the energy is wasted because only the area within the radiation pattern, i.e., the target, is receiving energy.

As shown in FIG. 2, main reflector 16, sub-reflector 20, and feed element 22 are positioned a given distance from each other. This distance is chosen so that main reflector 16 will produce a radiation pattern of nominal size and configuration. The radiation pattern has a complex shape because main reflector 16 is a shaped reflector.

However, many times it is desired to change the radiation pattern while satellite 12 is in orbit. A primary advantage of system 10 is that it allows the radiation pattern to be changed while the satellite is in orbit with a relatively simple procedure. Specifically, main reflector 16, sub-reflector 20, and feed element 22 are all slidably attached to sliding mechanism 24 so that they are displaceable with respect to one another. Because they are displaceable, the distance between them can be varied to enable defocusing. Defocusing changes the radiation pattern. Defocusing also changes the directivity, the gain, and the effective aperture of main reflector 16 and feed assembly 18.

Specifically, when at least one of main reflector 16, sub-reflector 20, and feed element 22 moves along sliding mechanism 24 the radiation pattern changes while satellite 12 is in orbit. Feed element 22 may also move along base 30 to enable defocusing and consequent changing of the radiation pattern.

Accordingly, a fairly wide variation of radiation patterns can be effected after satellite 12 is launched. These radiation patterns still have a complex shape because main reflector 16 is preferably a shaped reflector.

With reference still to FIG. 2, system 10 includes a programmable logic controller (PLC) 34 with an associated control module (not specifically shown). PLC 34 is operable with rotatable support 26, support 28, and support 32 to enable movement of main reflector 16, sub-reflector 20, and feed element 22 respectively along sliding mechanism 24. PLC 34 incorporates a driving element such as a stepping motor to accomplish the movement.

System 10 further includes a gimballing mechanism 36 operable with PLC 34. Gimballing mechanism 36 is operable with main reflector 16 to rotate and tilt the main reflector. The rotation and tilting of main reflector 16 enables the radiation pattern to be steered. Accordingly, with the use of defocusing and gimballing, a radiation pattern of varying size can be placed over many different regions of the earth.

Figure 3:
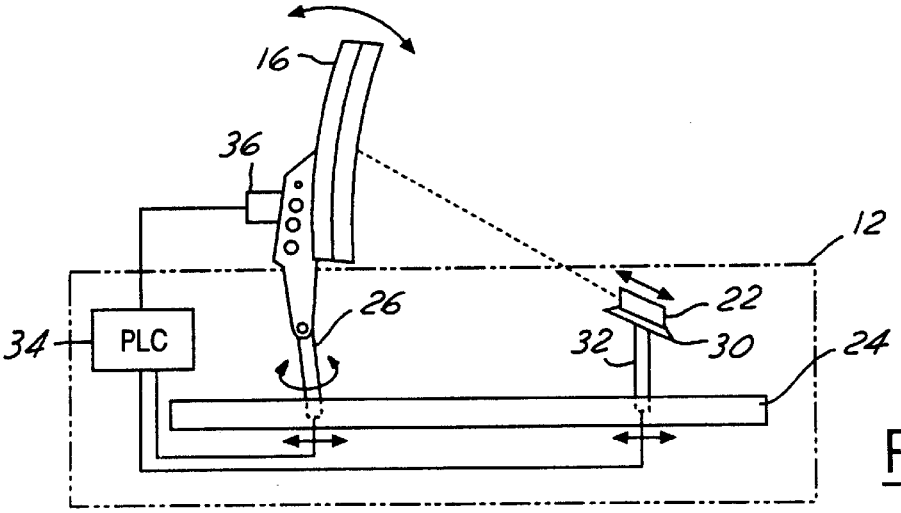
FIG. 3 is a top plan view of the communication satellite shown in FIG. 2 with an alternative embodiment of an antenna system.

Referring now to FIG. 3, a top plan view of an alternative embodiment of the present invention is shown. The elements shown in FIG. 3 are the same as those shown in FIG. 2. Accordingly, these elements have been designated with the same reference numerals.

The basic difference between the embodiment shown in FIG. 3 with that shown in FIG. 2 is that feed element 22 is pointed directly at main reflector 16 to illuminate the main reflector. Main reflector 16 and feed element 22 are slidably attached to sliding mechanism 24 on respective supports to enable defocusing. Similarly, feed element 22 is slidably attached to base 30 to enable defocusing. Thus, when main reflector 16 and feed element 22 are displaced with respect to one another, defocusing occurs and the radiation pattern changes.

Figure 4A:
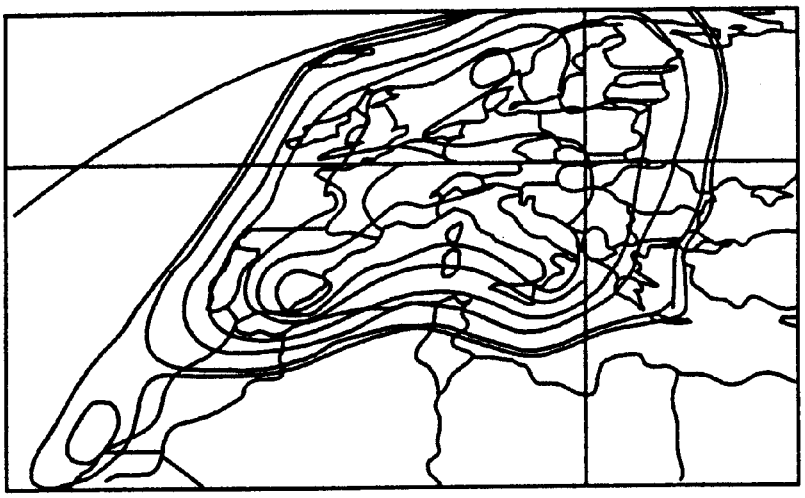
FIG. 4*a* is an example of a radiation pattern without defocusing.
Figure 4B:
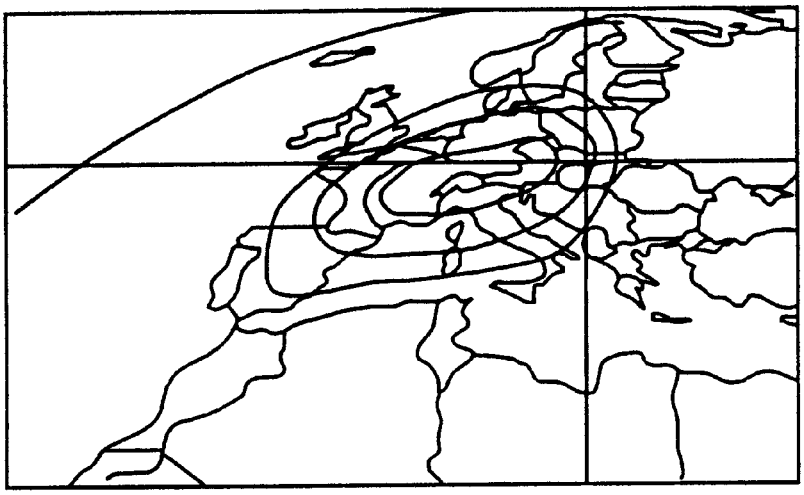
FIG. 4*b* is an example of a radiation pattern with 12 cm defocusing.
Figure 4C:
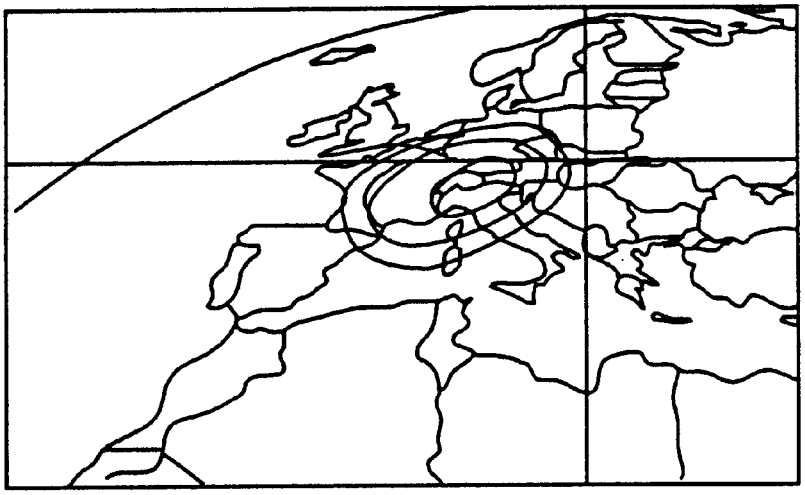
FIG. 4*c* is an example of a radiation pattern with 25 cm defocusing.

FIGS. 4*a*, 4*b*, and 4*c* illustrate the effects of defocusing system 10 of the present invention. In FIG. 4*a*, main reflector 16 and feed assembly 18 are positioned with respect to one another to produce a radiation pattern covering most of Europe. Then defocusing occurs when at least one of main reflector 16 and feed assembly 18 are displaced with respect to one another. The resulting radiation pattern, which is more compact than the one shown in FIG. 4*a*, is illustrated in FIG. 4*b*. More defocusing occurs when at least one of main reflector 16 and feed assembly 18 are displaced even further with respect to one another. The resulting radiation pattern, which is the most compact of all, is illustrated in FIG. 4*c*.

The amount of compactness or change of the radiation pattern is not a linear function of the displacement between main reflector 16 and feeder assembly 18. For instance, main reflector 16 and feeder assembly 18 may be moved away from one another to accomplish a more compact radiation pattern. If they are moved away further, the radiation pattern may become even more compact or it may broaden. However, the important concept is that the radiation pattern does change when main reflector 16 and feeder assembly 18 are moved with respect to one another. Accordingly, on-orbit reconfiguration of the radiation pattern can be achieved.

Figure 5A:
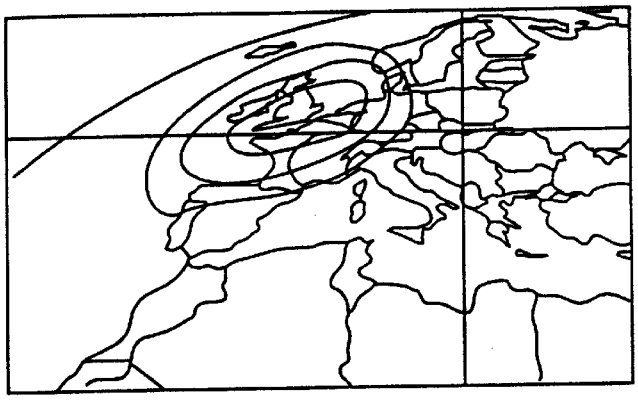
FIG. 5*a* is an example of gimballing the radiation pattern of FIG. 4*b*.
Figure 5B:
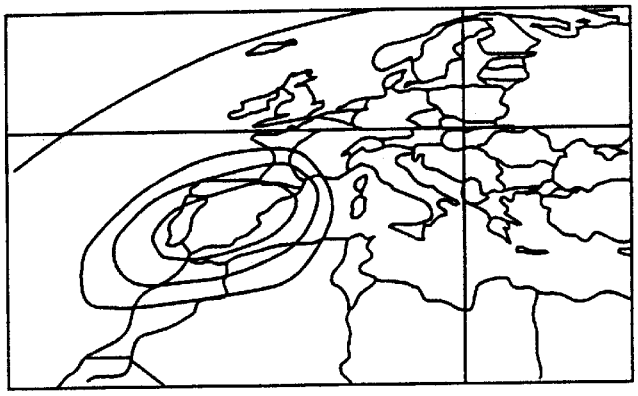
FIG. 5*b* is another example of gimballing the radiation pattern of FIG. 4*b*.

In addition to providing radiation patterns of varying size, the present invention provides the ability to steer the radiation pattern. The steering of the radiation pattern is achieved by rotating and tilting main reflector 16 with gimballing mechanism 34. The acts of rotating and tilting are referred to as gimballing. As shown in FIG. 5*a*, the radiation pattern of FIG. 4*b* has been steered to cover Great Britain and surrounding areas. This same radiation pattern may be steered to cover Spain and surrounding areas as shown in FIG. 5*b*.

Figure 6A:
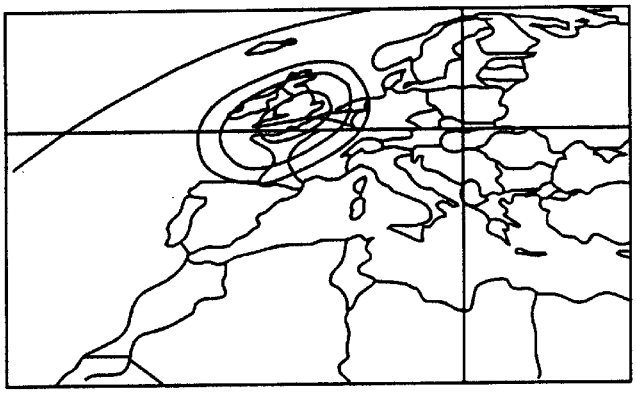
FIG. 6*a* is an example of gimballing the radiation pattern of FIG. 4*c*.
Figure 6B:
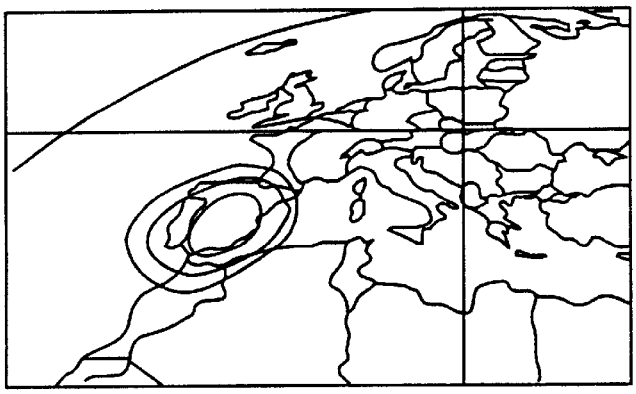
FIG. 6*b* is another example of gimballing the radiation pattern of FIG. 4*c*.

With gimballing and defocusing working together in conjunction, satellite 12 has the ability to function as if it were a group of satellites. Moving one of main reflector 16 and feeder assembly 18 causes defocusing and corresponding changes in the radiation pattern. For instance, after defocusing the radiation pattern of FIG. 5*a* may become more tighter to just cover Great Britain and not the surrounding areas as shown in FIG. 6*a*. Similarly, after defocusing the radiation pattern of FIG. 5*b* may become more tighter to just cover Spain and not the surrounding areas as shown in FIG. 6*b*.

Figure 7:
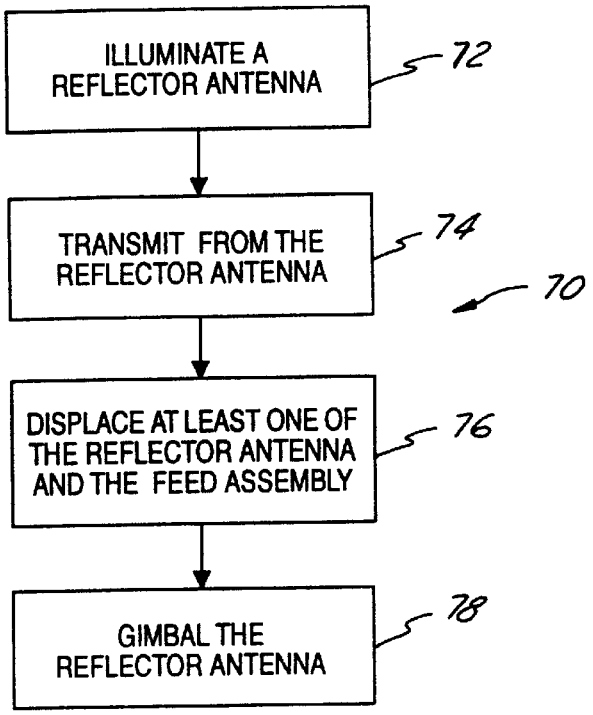
FIG. 7 is a flow diagram representing operation of a transmitting system and method according to the present invention.

Referring now to FIG. 7, a flow diagram 70 representing operation of a transmitting system and method according to the present invention is shown. In general, flow diagram 70 transmits a variable sized radiation pattern which may be steered. Flow diagram 70 begins with block 72 illuminating a reflector antenna with electromagnetic energy from a feed assembly. Block 74 then transmits the electromagnetic energy from the reflector antenna. The reflector antenna has a radiation pattern. Block 76 then displaces at least one of the reflector antenna and the feeder assembly to defocus these devices. The defocusing causes the radiation pattern to be changed. Block 78 then steers the radiation pattern by rotating and tilting the reflector antenna.

Figure 8:
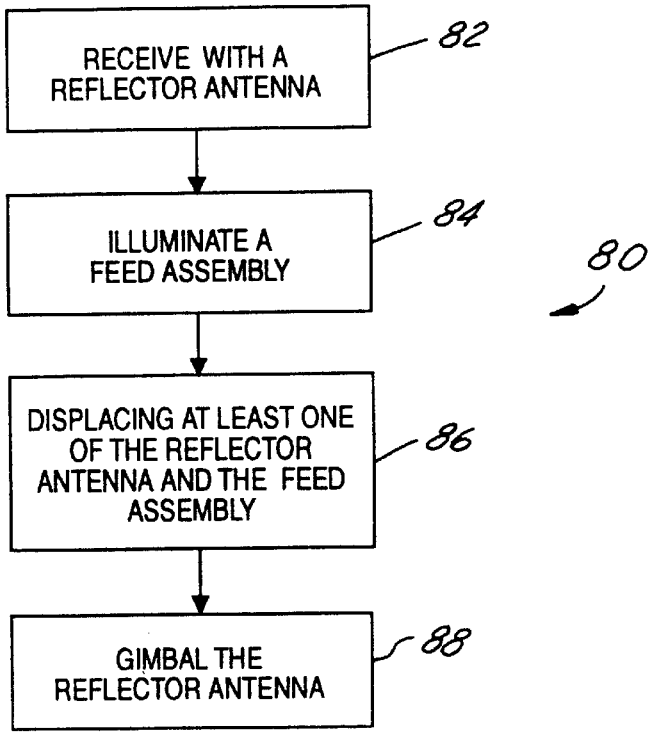
FIG. 8 is a flow diagram representing operation of a receiving system and method according to the present invention.

Referring now to FIG. 8, a flow diagram 80 representing operation of a receiving system and method according to the present invention is shown. In general, flow diagram receives a variable sized radiation pattern which may be steered. Flow diagram 80 begins with block 82 receiving electromagnetic energy with a reflector antenna. The reflector antenna has a radiation pattern. Block 84 then illuminates a feed assembly with the electromagnetic energy from the reflector antenna. Block 86 then displaces at least one of the reflector antenna and the feed assembly to defocus these devices. The defocusing causes the radiation pattern to be changed. Block 88 then rotates and steers the radiation pattern by rotating and tilting the reflector antenna.

Embodiments of the present invention can be incorporated as a standard package on satellites. In principle, a satellite with this capability can achieve the performance of multiple satellites.

Furthermore, the antenna system used need not be limited to a single shaped reflector or single parabolic reflector with associated feeder assemblies. For instance, a dual-gridded reflector or dual reflector systems with associated feeder assemblies may also be used.

It should be noted that the present invention may be used in a wide variety of different constructions encompassing many alternatives, modifications, and variations which are apparent to those with ordinary skill in the art. Accordingly, the present invention is intended to embrace all such alternatives, modifications, and variations as fall within the spirit and broad scope of the appended claims.

What is claimed is:

1. A satellite positioned in orbit above the Earth for transmitting a radiation pattern of electromagnetic energy to the Earth, the satellite comprising:

a sliding mechanism;

a shaped reflector for transmitting a shaped radiation pattern of electromagnetic energy to the Earth; and a feed assembly positioned at a given distance from the shaped reflector for illuminating the shaped reflector with electromagnetic energy;

wherein the shaped reflector transmits the electromagnetic energy received from the feed assembly in the radiation pattern to the Earth;

wherein at least one of the shaped reflector and the feed assembly is movably mounted to the sliding mechanism to vary the given distance between the shaped reflector and the feed assembly for defocusing the shaped reflector and the feed assembly thereby changing the radiation pattern of electromagnetic energy transmitted to the Earth while the satellite is in orbit above the Earth.

2. The satellite of claim 1 further comprising:

a gimballing mechanism for tilting and rotating the shaped reflector to steer the radiation pattern.

3. The satellite of claim 1 wherein the feed assembly comprises:

a sub-reflector; and a feed element for illuminating the sub-reflector with electromagnetic energy;

wherein the sub-reflector illuminates the shaped reflector with the electromagnetic energy received from the feed element.

4. The satellite of claim 3 wherein at least one of the sub-reflector and the feed element is movably mounted to the sliding mechanism.

5. The satellite of claim 1 further comprising:

a stepping motor cooperating with the sliding mechanism to move at least one of the shaped reflector and the feed assembly.

6. The satellite of claim 1 wherein the feed assembly is offset from an axis extending through and perpendicular to an origin of the shaped reflector.

7. A method for a satellite positioned in orbit above the Earth for transmitting a radiation pattern of electromagnetic energy to the Earth, wherein the satellite is provided with a feed assembly and a shaped reflector, the method comprising:

positioning the feed assembly at a given distance from the shaped reflector;

illuminating the shaped reflector with electromagnetic energy from the feed assembly;

transmitting the electromagnetic energy from the shaped reflector in a shaped radiation pattern to the Earth; and displacing at least one of the shaped reflector and the feed assembly to vary the given distance between the shaped reflector and the feed assembly for defocusing the shaped reflector and the feed assembly thereby changing the radiation pattern of electromagnetic energy transmitted to the Earth while the satellite is in orbit above the Earth.

8. The method of claim 7 wherein illuminating the shaped reflector with electromagnetic energy from the feed assembly comprises:

illuminating a sub-reflector with electromagnetic energy from a feed element; and illuminating the shaped reflector with the electromagnetic energy received by the sub-reflector.

9. The method of claim 8 wherein displacing at least one of the shaped reflector and the feed assembly comprises:

displacing at least one of the shaped reflector, the sub-reflector, and the feed element.

10. The method of claim 7 further comprising:

steering the radiation pattern by tilting and rotating the shaped reflector.

11. A method for a satellite positioned in orbit above the Earth for receiving a radiation pattern of electromagnetic energy from the Earth, wherein the satellite is provided with a feed assembly and a shaped reflector, the method comprising:

positioning the feed assembly at a given distance from the shaped reflector;

receiving electromagnetic energy from the Earth in a radiation pattern with the shaped reflector;

illuminating the feed assembly with the electromagnetic energy received from the shaped reflector; and displacing at least one of the shaped reflector and the feed assembly to vary the given distance between the shaped reflector and the feed assembly for defocusing the shaped reflector and the feed assembly thereby changing the radiation pattern of electromagnetic energy received from the Earth while the satellite is in orbit above the Earth.

12. The method of claim 11 wherein illuminating the feed assembly with the electromagnetic energy received from the shaped reflector comprises:

illuminating a sub-reflector with electromagnetic energy from the shaped reflector; and illuminating a feed element with the electromagnetic energy received from the sub-reflector.

13. The method of claim 12 wherein displacing at least one of the shaped reflector and the feed assembly comprises:

displacing at least one of the shaped reflector, the sub-reflector, and the feed element.

14. The method of claim 11 further comprising:

steering the radiation pattern by rotating and tilting the shaped reflector.

* * * * *